US007311540B1

(12) United States Patent
Lin

(10) Patent No.: US 7,311,540 B1
(45) Date of Patent: Dec. 25, 2007

(54) SAFETY MECHANISM ADAPTED FOR A LIGHT BULB SOCKET SO AS TO SECURELY RECEIVE THEREIN AN ENERGY SAVING BULB

(76) Inventor: Chia-Kuan Lin, 4F, No. 50, Sanmin Rd., Lujhou City, Taipei Hsien (TW)

( * ) Notice: Subject to any disclaimer, the term of this patent is extended or adjusted under 35 U.S.C. 154(b) by 0 days.

(21) Appl. No.: 11/476,152

(22) Filed: Jun. 28, 2006

(51) Int. Cl.
*H01R 27/00* (2006.01)

(52) U.S. Cl. ..... 439/220; 439/242

(58) Field of Classification Search ..... 439/220, 439/242, 375, 374, 182, 226–229, 56, 168, 439/280, 137–145, 893, 602, 611, 619, 336, 439/699.2, 414, 356, 342, 147; 174/67; 362/430, 362/147, 226, 404, 427, 431
See application file for complete search history.

(56) References Cited

U.S. PATENT DOCUMENTS 5,376,025 A * 12/1994 Willnat et al. ..... 439/817
6,213,816 B1 * 4/2001 Meichsner et al. ..... 439/699.2
6,824,409 B2 * 11/2004 Thiele et al. ..... 439/242

* cited by examiner

*Primary Examiner*—Edwin A. Leon
(74) *Attorney, Agent, or Firm*—Birch, Stewart, Kolasch & Birch, LLP

(57) ABSTRACT

A safety mechanism includes a pair of sliding blocks each movably received inside the light bulb socket and a releasing block operably connected to each of the pair of sliding blocks to activate movement of the sliding blocks for releasing an energy saving light bulb. Each of the sliding blocks is provided with a first spring received in a first receiving compartment, an inclined first abutting face and a positioning recess so that when the insertion head of the energy saving light bulb passes over the wedged head of the sliding block, the sliding block is moved to allow the insertion head of the energy saving light bulb to be moved from the insertion hole to the positioning hole.

4 Claims, 5 Drawing Sheets

SAFETY MECHANISM ADAPTED FOR A LIGHT BULB SOCKET SO AS TO SECURELY RECEIVE THEREIN AN ENERGY SAVING BULB

BACKGROUND OF THE INVENTION

1. Field of the Invention

The present invention relates to a safety mechanism, and more particularly to a safety mechanism adapted for a light bulb socket so as to securely receive therein n energy saving bulb.

2. Description of the Prior Art

A conventional light bulb socket for an energy saving light bulb includes two arcuate insertion holes diagonally and respectively defined around a central axis of the light bulb socket. Each insertion hole includes a receiving hole and a positioning hole in communication with the receiving hole. An energy saving light bulb is provided with an insertion head and an insertion body to correspond to the receiving hole and the positioning hole. The receiving hole has a diameter larger than that of the insertion head and the positioning hole has a diameter smaller than the insertion head, yet larger than the insertion body. Therefore, after the insertion head of the energy serving light bulb is inserted into the receiving hole and the light bulb is moved from the receiving hole to the positioning hole, the insertion head is thus retained by the positioning hole.

However, because the inner periphery of the insertion hole is smooth, the energy saving light bulb might be easily deviated from the positioning hole if there is an additional force applied to the light bulb. Sometimes, the light bulb might fall directly from the light bulb socket, which is quite dangerous.

In order to solve the problem, a locking block is provided to the outer periphery of the insertion head and a locking recess is defined in an outer periphery of the positioning hole in the light bulb socket to correspond to and receive therein the locking block after the insertion head is positioned in the positioning hole so that the light bulb is securely received inside the positioning hole. Although the provision of the locking block and the locking recess does solve the problem to prevent the light bulb from falling off the light bulb socket, the assembly process is increased and becomes complex when compared with the conventional assembly process.

To overcome the shortcomings, the present invention tends to provide an improved safety mechanism to mitigate the aforementioned problems.

SUMMARY OF THE INVENTION

The primary objective of the present invention is to provide a safety mechanism adapted in a light bulb socket to securely receive therein an energy saving light bulb.

In order to overcome the aforementioned objective, the safety mechanism of the present invention includes a pair of sliding blocks each movably received inside the light bulb socket and a releasing block operably connected to each of the pair of sliding blocks to activate movement of the sliding blocks for releasing an energy saving light bulb.

Another objective of the present invention is that each of the sliding blocks is provided with a first spring received in a first receiving compartment, an inclined first abutting face and a positioning recess so that when the insertion head of the energy saving light bulb passes over the wedged head of the sliding block, the sliding block is moved to allow the insertion head of the energy saving light bulb to be moved from the insertion hole to the positioning hole.

Still another objective of the present invention is that the releasing block is provided with a second spring received in a second receiving compartment defined inside the releasing block, an inclined second abutting face corresponding to the first abutting face of the sliding block such that when the releasing block is moved to engage the second abutting face with the first abutting face of the sliding block, the sliding block is forced to move to release restriction to the insertion head of the energy saving light bulb.

Other objects, advantages and novel features of the invention will become more apparent from the following detailed description when taken in conjunction with the accompanying drawings.

DETAILED DESCRIPTION OF THE PREFERRED EMBODIMENT

Figure 1:
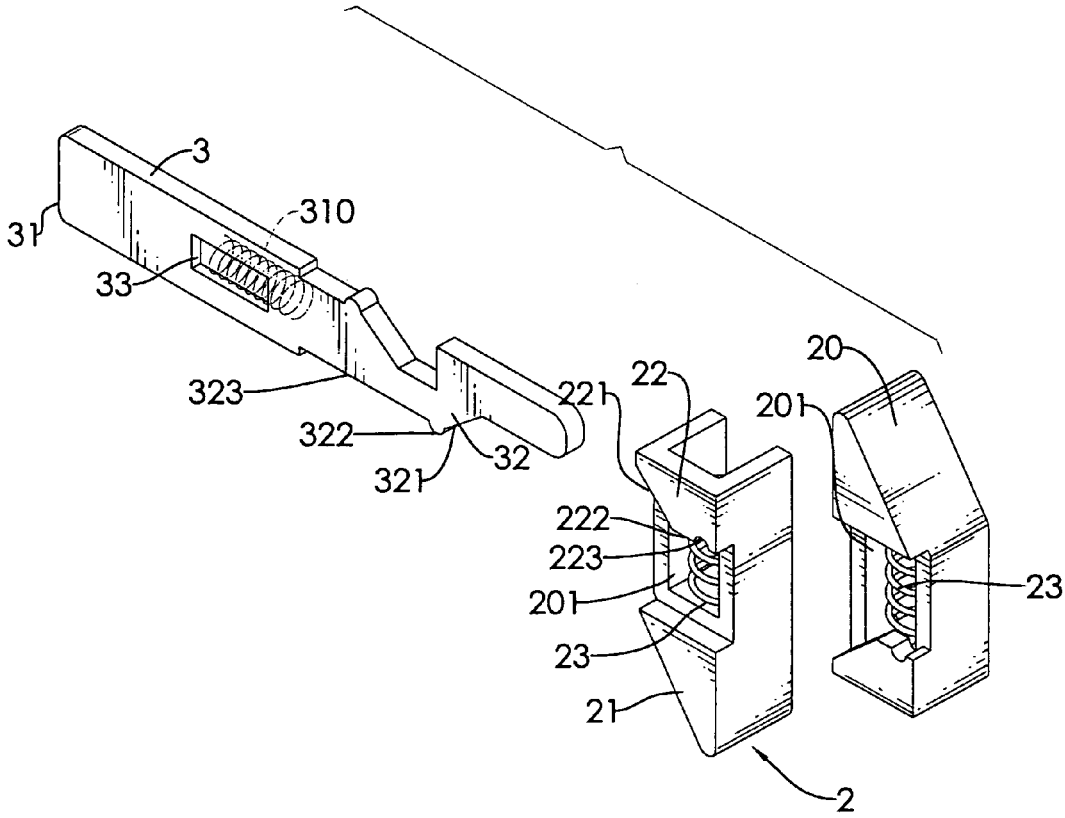
FIG. 1 is an exploded perspective view of the safety mechanism of the present invention.

With reference to FIG. 1, it is noted that the safety mechanism in accordance with the present invention includes two sliding blocks (2) and a releasing block (3) operably connected to the two sliding blocks (2) to drive the two sliding blocks (2) to move.

Each sliding block (2) is provided with a body (20) with a first passage (201) defined therein, a wedged head (21) formed on a free end of the body (20) opposite to an opening of the passage (201), an abutting block (22) formed on a side of the body (20) and having an inclined first abutting face (221), a positioning recess (223) and a first plane (222) formed between a distal end of the first abutting face (221) and the positioning recess (223) and a first spring (23) received in the first passage (201).

The releasing block (3) is provided with an elongated body (31) and two acting portions (32) respectively formed on two opposite sides of the elongated body (31). Each acting portion (32) includes an inclined second abutting face (321) to correspond to and engage with the inclined first abutting face (221) of the sliding block (2), a boss (322) formed on a distal end of the inclined second abutting face (321) to correspond to and be received in the positioning recess (223) and a second plane (323) adjacent to the boss (322) to correspond to the first plane (222). A second spring (33) is received in a second passage (310) defined in the elongated body (31).

Figure 2:
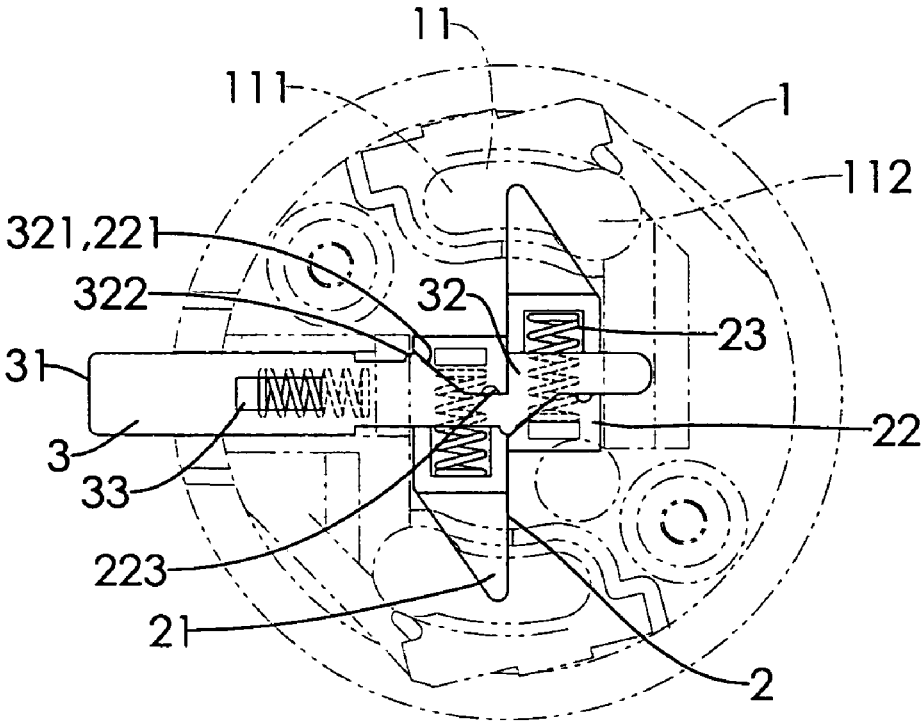
FIG. 2 is a top plan view of the safety mechanism in a light bulb socket.
Figure 4:
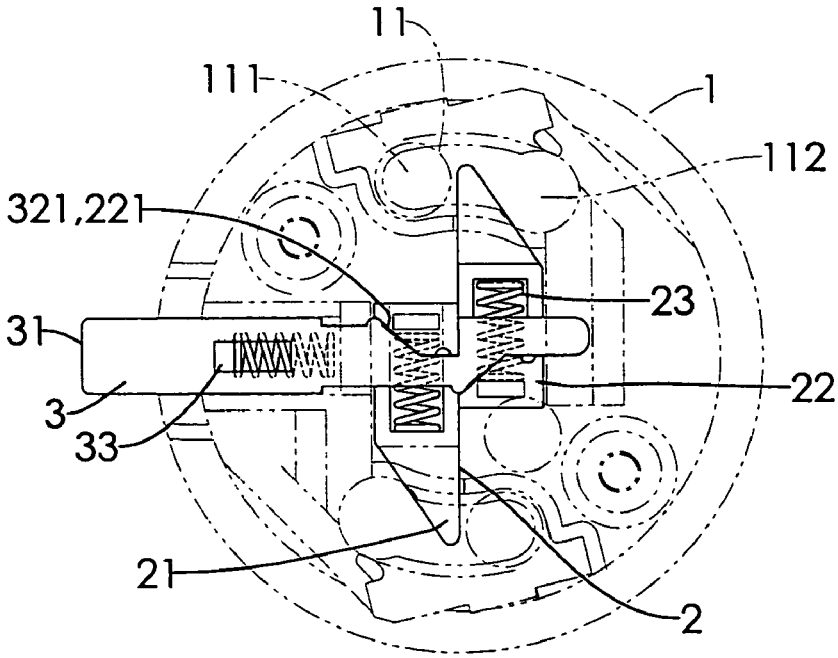
FIG. 4 is an operational view showing that the two insertion heads of the light bulb are respectively retained by the two wedged heads of the two sliding blocks.
Figure 5:
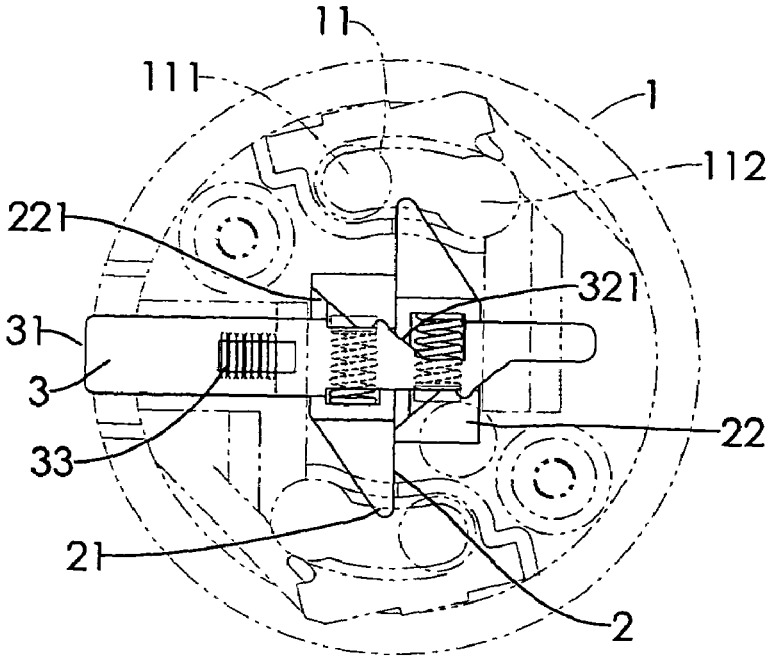
FIG. 5 is an operational view showing that the releasing block is moved to retract the two sliding blocks into the light bulb socket.
Figure 6:
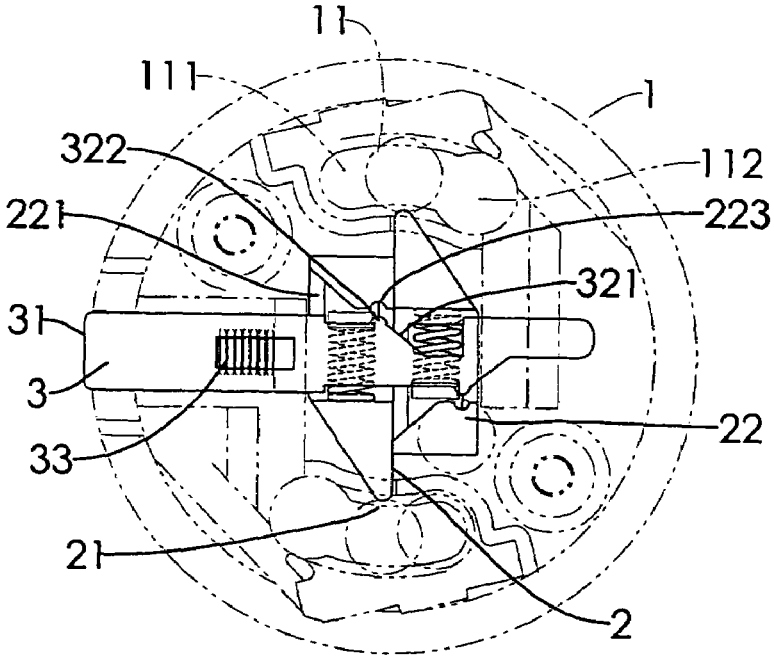
FIG. 6 is an operational view showing that the two insertion heads of the light bulb further press the two wedged heads of the two sliding blocks to release the limitation from the releasing block to the sliding blocks.
Figure 7:
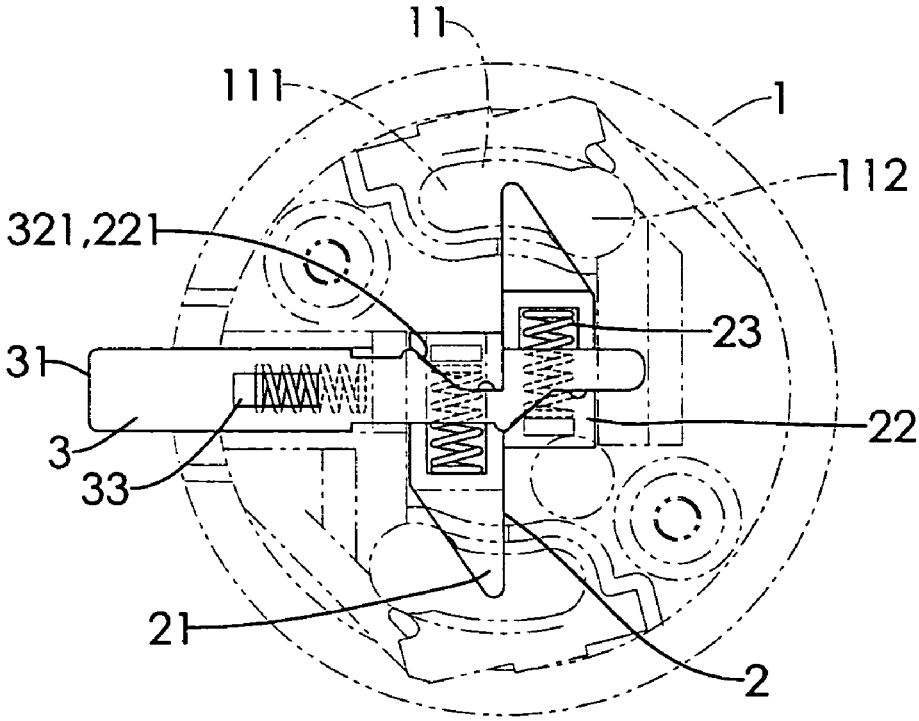
FIG. 7 is a top plan view showing that the light bulb socket is ready for receiving insertion heads of an energy saving light bulb.

With reference to FIG. 2, it is noted that the safety mechanism of the present invention is employed in a light bulb socket which includes two holes (11) diagonally defined in a face of a socket plate (1) for respectively receiving therein insertion heads (4), as shown in FIG. 4, of an energy saving light bulb (not shown). Each hole (11) is composed of an insertion hole (112) and a positioning hole (111) in communication with the insertion hole (112). The two sliding blocks (2) are oppositely located in the socket plate (1) and are positioned on the socket plate (1) in such a way that the wedged head (21) of each sliding block (2) is extending into a joint between the insertion hole (112) and the positioning hole (111). Further, the socket plate (1) is so configured that a guiding rod (not shown) is provided to extend into the first passage (201) to abut a free end of the first spring (23) such that each one of the sliding blocks (2) is able to move on the socket plate (1). The releasing block (3) is transversely and movably mounted on the socket plate (1) to allow the two inclined second abutting faces (321) to respectively abut the inclined first abutting faces (221) of the two sliding blocks (2).

Figure 3:
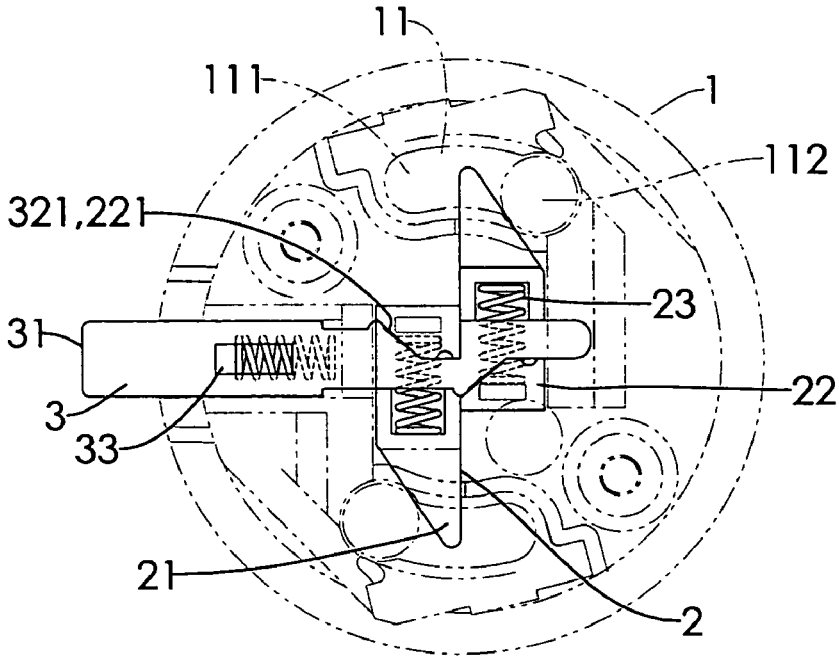
FIG. 3 is an operational view showing that two insertion heads from an energy saving light bulb is to be positioned in the light bulb socket with the safety mechanism of the present invention.

With reference to FIG. 3, due to the extension of the wedged head (21) of each of the two sliding blocks (2) and the inclined face of the wedged head (21) being faced to the insertion hole (112), after the insertion head of the energy saving light bulb is inserted into the insertion hole (112), movement of the insertion head toward the positioning hole (111) from the insertion hole (112) is allowed. That is, the wedged head (21) of the sliding block (2) will be pressed into the socket plate (1) to allow the insertion head to move toward the positioning hole (111). However, if the insertion head is to be moved from the positioning hole (111) to the insertion hole (112), the wedged head (21) stops the movement of the insertion head such that the insertion head is securely received in the positioning hole (111). In another word, the energy saving light bulb is securely connected to the light bulb socket and the operator does not worry that the light bulb might fall off from the light bulb socket.

Further, the releasing block (3) is also movably mounted on the socket plate (1) to allow one end thereof to extend out of the light bulb socket and the other end thereof to extend into the socket plate (1). Due to the provision of the inclined second abutting face (321), the boss (322) and the second plate (323) on the opposite faces of the elongated body (31), the two inclined second faces (321) respectively engage with the two inclined first abutting faces (221), the two bosses (322) respectively correspond to and are received in the two positioning recesses (223) and the two second planes (323) correspond to the two first planes (222). In addition, the socket plate (1) is so configured that a guiding rod is extended into the second passage (310) to abut a free end of a second spring (33) that is received in the second passage (310) to allow the releasing block (3) to move relative to the socket plate (1).

With reference to FIGS. 3, 4, 5, 6 and 7, to release the insertion head of the energy saving light bulb, the operator pushes the releasing block (3) to allow the two inclined second abutting faces (321) respectively abutting the two inclined first abutting faces (221) to force the two sliding blocks (2) to move in a direction away from the positioning hole (111) as well as the insertion hole (112). While the releasing block (3) is moved, the two bosses (322) are respectively received in the corresponding positioning recesses (223) to secure the position of the two sliding blocks (2). After the two sliding blocks (2) are moved, the insertion heads of the energy saving light bulb are able to move from the positioning hole (111) to the insertion hole (12). When the insertion heads pass over the wedged heads (21) respectively, the sliding blocks (2) are further pressed such that the bosses (322) are away from the limitation of the positioning recesses (223) to allow the wedged heads (21) to resume to their original positions respectively.

In conclusion, it is noted that the safety mechanism of the present invention obviate the worry that the light bulb might fall off from the light bulb socket. Furthermore, the provision of the releasing block (3) easily deactivate the locking effect to the sliding blocks (2) to be ready for receiving another light bulb.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A safety mechanism in a light bulb socket having a socket plate and a pair of holes diagonally defined in the socket plate, each hole being composed of an insertion hole and a positioning hole, the safety mechanism comprising:

at least one sliding block movably received in the socket plate and having a body, a wedged head formed on a distal end of the body extending into a joint between the insertion hole and the positioning hole, an abutting block formed on a side of the body and composed of an inclined first abutting face, a positioning recess and a first plane formed between the first abutting face and the positioning recess; and a releasing block movably mounted in the socket plate and having an elongated body and provided with, on at least one side face thereof, an inclined second abutting face corresponding to and engaged with the first abutting face of the at least one sliding block, a boss adjacent to a distal end of the inclined second abutting face to correspond to and be received in the positioning recess and a second plane to correspond to the first plane such that when an insertion head of a light bulb is inserted into the insertion hole, the insertion head is easily extend over the wedged head of the sliding block to be securely received in the positioning hole and when the insertion head is to be away from the hole, movement of the releasing block toward the at least one sliding block allows the boss to be received in the positioning recess and forces the at least one sliding block to move away from the hole to free the insertion head from the wedged head and movement of the insertion head releases limitation to the boss from the positioning recess as a result of engagement between the insertion head and the wedged head, wherein there are two oppositely located sliding blocks respectively corresponding to one of the two holes, each of the two sliding blocks is further provided with a first passage to receive therein a first spring so that the two sliding block are able to move, the releasing block has a second passage defined therein to receive a second spring so that the sliding block is able to move.

2. The safety mechanism as claimed in claim 1, wherein the inclined second abutting face corresponding to and engaged with the first abutting face of the two sliding blocks, the boss adjacent to a distal end of the inclined second abutting face to correspond to and be received in the positioning recess and a second plane to correspond to the first plane are respectively formed on two opposite faces of the elongated body of the sliding block.

3. In a light bulb socket having a socket plate and a pair of holes diagonally defined in the socket plate for receiving therein a pair of insertion heads of a light bulb, wherein the improvements comprise:

at least one sliding block movably received in the socket plate and having a body, a wedged head formed on a distal end of the body to be adapted to be extending into a joint between the insertion hole and the positioning hole, an abutting block formed on a side of the body and composed of an inclined first abutting face, a positioning recess and a first plane formed between the first abutting face and the positioning recess; and a releasing block movably mounted in the socket plate and having an elongated body and provided with, on at least one side face thereof, an inclined second abutting face corresponding to and engaged with the first abutting face of the at least one sliding block, a boss adjacent to a distal end of the inclined second abutting face to correspond to and be received in the positioning recess and a second plane to correspond to the first plane such that when an insertion head is inserted into the insertion hole, the insertion head is easily extend over the wedged head of the sliding block to be securely received in the positioning hole and when the insertion head is to be away from the hole, movement of the releasing block toward the at least one sliding block allows the boss to be received in the positioning recess and forces the at least one sliding block to move away from the hole to free the insertion head from the wedged head and movement of the insertion head releases limitation to the boss from the positioning recess as a result of engagement between the insertion head and the wedged head, wherein there are two oppositely located sliding blocks respectively corresponding to one of the two holes, each of the two sliding blocks is further provided with a first passage to receive therein a first spring so that the two sliding block are able to move, the releasing block has a second passage defined therein to receive a second spring so that the sliding block is able to move.

4. The safety mechanism as claimed in claim 3, wherein the inclined second abutting face corresponding to and engaged with the first abutting face of the two sliding blocks, the boss adjacent to a distal end of the inclined second abutting face to correspond to and be received in the positioning recess and a second plane to correspond to the first plane are respectively formed on two opposite faces of the elongated body of the sliding block.

* * * * *